United States Patent [19]

Wong et al.

[11] Patent Number: 4,840,501

[45] Date of Patent: Jun. 20, 1989

[54] THREE POLE PRINTHEAD ACTUATOR

[75] Inventors: Kam C. Wong, Canoga Park; Bernard Rubinshtein, Agoura; Aram Arzoumanian, Woodland Hills, all of Calif.

[73] Assignee: Dataproducts Corporation, Woodland Hills, Calif.

[21] Appl. No.: 171,160

[22] Filed: Mar. 14, 1988

Related U.S. Application Data

[63] Continuation of Ser. No. 857,736, Apr. 29, 1986, abandoned.

[51] Int. Cl.[4] ..... B41J 3/12

[52] U.S. Cl. ..... 400/124; 101/93.05

[58] Field of Search ..... 400/121, 124, 157.2; 101/93.29, 93.48, 93.05, 93.04

[56] References Cited

U.S. PATENT DOCUMENTS

| | | | |
|---|---|---|---|
| 3,889,793 | 6/1975 | Cattaneo | 400/124 |
| 4,009,772 | 3/1977 | Glaser et al. | 400/124 |
| 4,135,830 | 1/1979 | Hishida et al. | 400/124 |
| 4,382,701 | 5/1983 | Davenport | 400/124 |
| 4,407,591 | 10/1983 | Adamoli et al. | 400/124 |
| 4,484,170 | 11/1984 | Wirth et al. | 400/124 |
| 4,541,745 | 9/1985 | Gugel | 400/124 |
| 4,568,207 | 2/1986 | Hara et al. | 400/124 |
| 4,594,010 | 6/1986 | Jachno | 400/124 |
| 4,626,115 | 12/1986 | Norigoe | 400/124 |
| 4,653,943 | 3/1987 | Sakaida et al. | 400/124 |

FOREIGN PATENT DOCUMENTS

| | | | |
|---|---|---|---|
| 120356 | 9/1981 | Japan | 101/93.05 |
| 84864 | 5/1982 | Japan | 400/124 |
| 126671 | 8/1982 | Japan | 400/124 |
| 17214 | 1/1984 | Japan | 400/124 |
| 123675 | 7/1984 | Japan | 400/124 |
| 187561 | 9/1985 | Japan | 101/93.05 |
| 40165 | 2/1986 | Japan | 400/124 |

*Primary Examiner*—David A. Wiecking

*Attorney, Agent, or Firm*—Spensley Horn Jubas & Lubitz

[57] ABSTRACT

A magnetic actuator particularly suitable to be arranged in a circular array to form a wire matrix printhead for mosaic, or dot, matrix printing. Each such magnetic actuator of three poles being (1) and "E"-shaped core defining three magnetic poles which is substantially thin in the thickness of the "E", which is that direction circumferentially along a circular array of such magnetic actuators, (2) a single coil wound around the center magnetic pole of such "E"-shaped core, and (3) an armature striding over all three magnetic poles. The armature is maintained at its pivot point by an O-ring which creates no moment of force to the striding of the armature. The "E"-shaped core may be comprised of laminated, or of solid, magnetic material and may further be structurally in common with the cores of other ones of the magnetic actuators as are arranged in the circular array.

10 Claims, 5 Drawing Sheets

THREE POLE PRINTHEAD ACTUATOR

This is a continuation of application Ser. No. 06/857,736 filed on Apr. 29th, 1986, now abandoned.

BACKGROUND OF THE INVENTION

1. Field of the Invention

The present invention generally concerns the structure of a magnetic actuator, one of a number of such radially arrayed in a wire (dot) matrix printhead, which actuator is improved for better packaging density and better coupling of magnetic forces. Specifically, the present invention concerns a three-pole magnetic actuator (1) with a single coil wound around the center magnetic pole, (2) with an "E"-shape core, and (3) with an armature striding over all three magnetic poles.

2. Description of the Prior Art

A wire, or dot, matrix printer includes a number of electromagnetic actuators for use as drive elements of the dot matrix. Printhead designs in the prior art generally consist of a series of such electromagnetic actuators arranged in a radial, or circular, array, or within a succession of superimposed such radial arrays. The actuators contain a yoke, generally of two poles, with armatures striding across the two poles. The armature connects to a force-transmitting wire, and acts as a lever to drive such wire in order to make a printed dot upon the workpiece paper.

One major electromagnetic actuator design present in the prior art employs two poles. This two-pole design is present in two major varients: one variant in which the armature pivots at the outer pole of the yoke, and another variant wherein the armature pivots at the inner pole of the yoke. Since magnetic flux flows in a symmetric way, such designs of a two-pole yoke carry only a fraction of the flux, "throwing away" almost 50% of the useful flux into the air. Further, such a design has undesirable width, or thickness, in the direction along which a number of such magnetic actuators will be radially arrayed to form a printhead actuating a like number of wires in order to form a like number of dots constituting a printed character. Such prior art two-pole magnetic actuators for wire matrix printers are distinquishable from the three poles of the present invention of a magnetic actuator, which invention is also of a specific "E"-shaped core geometry supporting tight packing.

Another class of prior art electromagnetic actuators for use as dot-matrix printer drive elements employs the magnetic "core and shell" geometry. This geometry is particularly visible in the figures of U.S. Pat. No. 3,828,908 for MOSAIC PRINTHEAD to Schneider. Each of the actuators consists of (1) a magnetic core and shell, (2) an armature, and (3) a bobbin where the armature is attached. Further use of "core and shell" magnetic actuators is shown in U.S. Pat. No. 3,876,050 for ARMATURE STRUCTURE FOR MOSAIC TYPE PRINTER to Linder, U.S. Pat. No. 4,236,836 for DOT IMPACT PRINTER AND ACTUATOR THEREFOR to Hodne, and U.S. Pat. No. 4,279,521 for WIRE MATRIX PRINT HEAD to Kightlinger. The Hodne patent particularly shows detailed illustration of the actuators, which have a cross-section of cylindrical geometry. Although such electromagnetic actuators might conceivably be said to embrace three-poles, and so appear when taken in cross-section, they are considerably different from the two-dimensional design geometry of the present invention based on a substantially two-dimensional "E"-shaped core. The cylindrical magnetic "core and shell" geometry poses a severe limitation on mechanical packaging. A considerably larger size along the direction of the array of such electromagnetic actuators is present than is present in the present invention of essentially two-dimensional three-pole yoke geometry. An interesting prior art solution to this packaging problem is shown in the Linder and Kightlinger patents wherein superimposed arrays of electromagnetic actuators are employed because the total number of actuators required cannot be circumferentially arrayed in a single circle of desired circumference. This is due to the physical dimension, circumferentially along such circular array, of each of such electromagnetic actuators.

SUMMARY OF THE INVENTION

The present invention is an improved design for an electromagnetic actuator usuable in a mosaic printhead consisting of a series of such magnetic actuators arranged in a radial, or circular, array or in a linear array. The electromagnetic actuator design of the present invention consists of a three-pole magnetic yoke with a single coil wound around the center pole. Further, such design is based upon an "E"-shaped core which is essentially two dimensional, being substantially thin in the thickness of the "E" being that direction along which the array of magnetic actuators will be circumferentially or linearly disposed. Further, an armature is striding over all three magnetic poles.

This design of the present invention using a third pole captures flux that was normally wasted in leakage in the two-pole prior art design. This additional flux is used in the design of the present invention to generate energy for printing, thereby resulting in increased efficiency and effectiveness for an individual magnetic actuator of fixed size, or allowing the reduction of the physical size of an individual magnetic actuator which will deliver the same printing energy. In addition to the smaller package, this design actually allows the actuator to run at higher frequency resulting in a higher speed printer. The higher frequency capability is a result of the ability to reduce the inertia of the armature with a smaller package while maintaining the effective force on the armature. More magnetic force is additionally delivered further from the pivot point, resulting in a high effective moment, which improves the speed of printing over prior art two-pole actuator designs.

In comparison to the prior art magnetic core and shell designs, the present invention, based on an "E"-shaped core which is essentially two-dimensional, will have considerably reduced dimension along the direction that a multiplicity of such magnetic actuators should be circularly or linearly arrayed. The width of the magnetic actuators of the present invention is such that 24 of such will routinely fit in a single radial, or circular, array of diameter less than 6 centimeters.

It is a further aspect of the present invention that the pivot point of the armature striding over all three poles should be defined by an O-ring in a manner that creates no moment of force to the striding of such armature. Such a moment of force, if present, would effect the dynamic response of the armature and degrade its performance in the actuation of the printing needle within the wire matrix printhead. The O-ring is located directedly over the pivoting edge, which is preferentially established at that pole of the armature which is outermost relative to the radial array of magnetic actuators.

The pivoting edge may also be located at the pole of the armature which is innermost relative to the radial array of the magnetic actuators.

Further as an aspect of the present invention, the individual actuators may have an "E"-shaped core, or yoke, either of laminated or of solid magnetic materials. Finally, a variant of the present invention permits the use of a common yoke, presenting the "E"-shaped core at the position of each of the magnetic actuators, on all of the magnetic actuators radially arrayed in the same printhead. This common yoke may also be laminated, be sintered, or be made by the casting of magnetic materials.

Correspondingly, it is a first object of the present invention that a magnetic actuator efficient and effective in the use of magnetic force to produce energy for actuation for an individual printing needle within a wire-matrix printhead may be shown. It is a second object of the present invention that such magnetic actuator efficient and effective in the generation of magnetic force may be of substantially thin dimension along the direction that a series of such would be circumferentially or linearly arrayed in order to form an entire magnetic printhead. It is a third object of the present invention that the pivot point of an armature striding over the magnetic poles of the magnetic actuator should be established by means that contribute no moment of force to the striding of such armature, which moment of force would negatively effect the dynamic response and performance of the striding armature. It is a fourth, and final, object of the present invention that the magnetic actuators of improved design should have yokes constructable of laminated, or of solid, magnetic materials and might even be constructed so that all the circularly arrayed magnetic actuators within the same printheld should share a common yoke, which may likewise be of laminated or of solid magnetic materials.

DESCRIPTION OF THE PREFERRED EMBODIMENT

The present invention is an improved geometry individual magnetic actuator interactive with a series of like magnetic actuators arranged in a radial, or circular, array particularly in order to create a mosaic printhead useful for dot matrix printing. The improved geometry magnetic actuator of the present invention will be seen to consist of a three-pole magnetic actuator (1) with a single coil wound around the center magnetic pole, (2) with an "E"-shaped core which is essentially two-dimensional, being substantially thin in the thickness of the "E", which thickness is in the direction linearly or circumferentially along the linearly or circularly arrayed magnetic actuators, and (3) with an armature striding over all three magnetic poles.

Figure 1A:
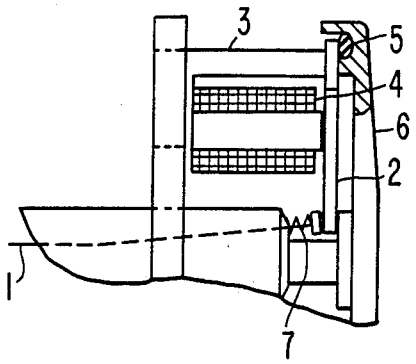
FIG. 1a. (PRIOR ART)
FIG. 1, consisting of FIG. 1*a* and FIG. 1*b*, shows a sectional view of the prior art two-pole magnetic actuator for a mosaic, or wire matrix, printhead.
Figure 1B:
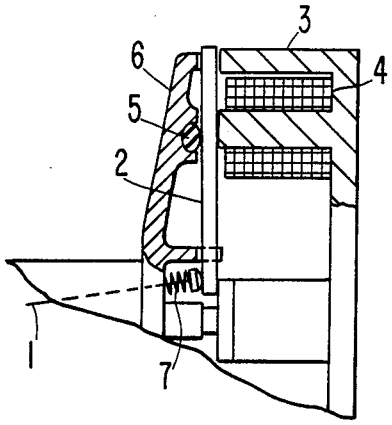
FIG. 1b. (PRIOR ART)

In comparison to the present invention, certain prior art actuators used in the radially arrayed printhead designs are relevant of comparison. Two such actuators, each using a yoke with two poles and armatures striding across the two poles are shown in FIG. 1. The armature design shown in FIG. 1*a* pivots at the outer pole of the yoke, and the armature design shown in FIG. 1*b* pivots at the inner pole of the yoke. Within FIG. 1, the representative printing needle 1 is driven within a guide (not shown) by armature 2 in order to make, at its end terminus (not shown) a printed dot upon the workpiece paper (not shown). The magnetic yoke 3 is "U"-shaped, consisting of two poles. A field coil 4 is wound around one of the legs, which leg thereafter serves as the core. The magnetic force applied to the armature 2 by magnetic flux coupled to such through yoke 3 when field coil 4 is energized will cause the motion of such to transpire relative to pivot point 5 held within retaining housing 6. The armature 2, and needle 1, will be enabled to return to the rest, non-print, position after the cessation of application of magnetic force by spring 7.

Figure 2:
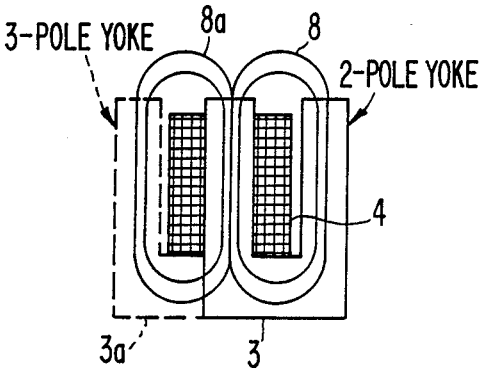
FIG. 2 shows a diagrammatic representation of the improved magnetic flux coupling of the magnetic actuator of the present invention employing a three-pole yoke.

A diagrammatic illustration of the inefficient usage of magnetic flux by the two-pole yoke design of the prior art shown in FIG. 1, versus the three-pole yoke design of the present invention, is shown in FIG. 2. The two-pole, "U"-shaped, magnetic yoke 3 previously seen in FIG. 1 is shown in solid line at the right. The field coil 4 previously shown in FIG. 1 which is around a leg of such two-pole yoke 3 is shown. The flux which would be coupled by such two-pole yoke 3 to the armature disposed upon the top of such yoke is only that flux 8 illustrated to the right in FIG. 2. If, however, the yoke is expanded to the three-pole yoke design of the present invention, as is illustrated by the additional structural area enclosed in dash line labeled 3*a* in FIG. 2, then the same field coil l4 of the structure will allow essentially twice the magnetic flux to be coupled to an armature now disposed across all three poles of such expanded yoke. This additional flux is illustrated by the flux lines 8*a* diagrammatically illustrated at the left of FIG. 2.

Figure 3:
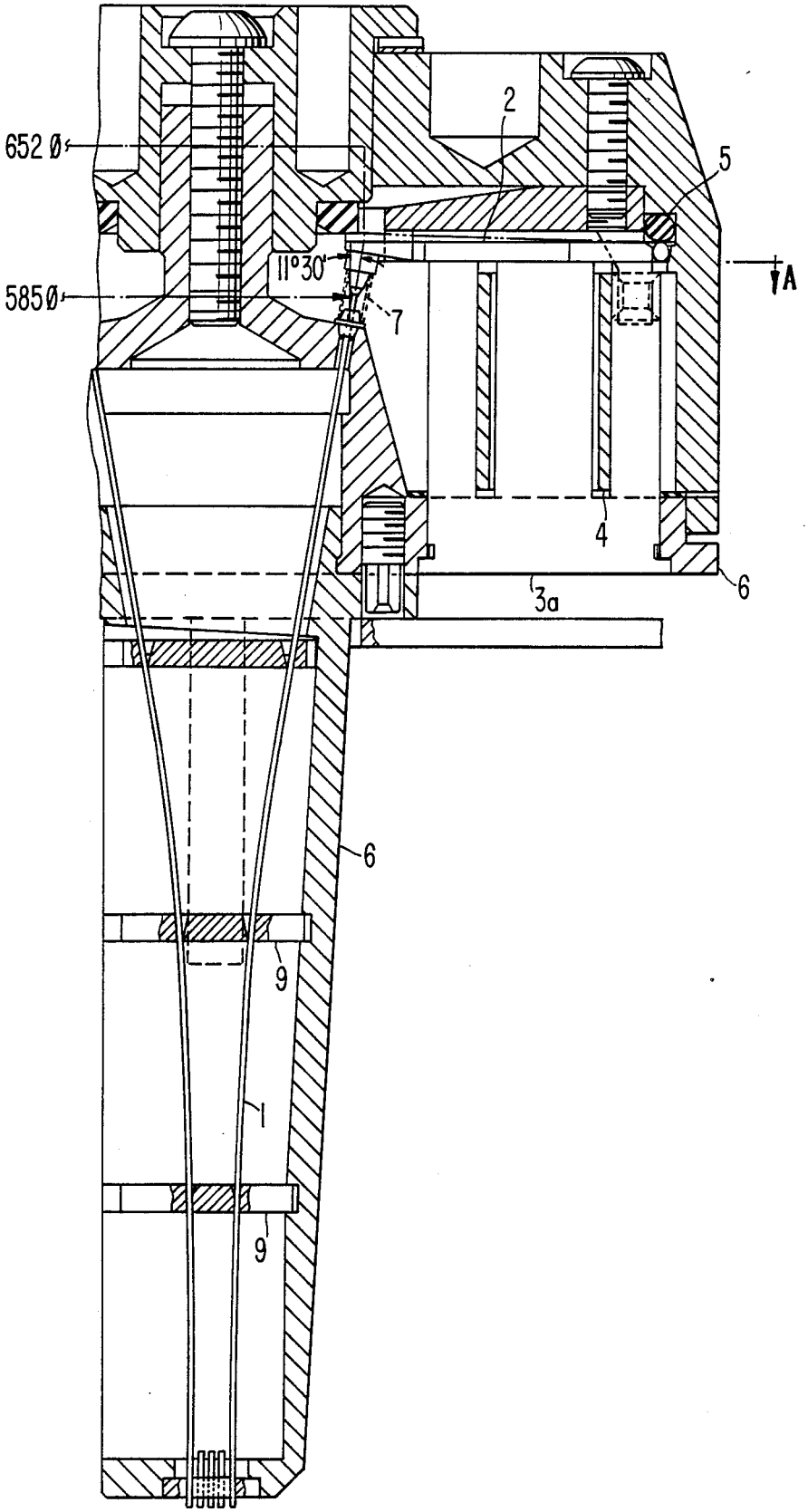
FIGS. 3 and 3*a* show in cross-sectional view the improved geometry magnetic actuator of the present invention disposed within the mosaic printhead within which it is employed.

The present invention of a three-pole magnetic actuator usuable in a matrix printhead is shown in FIG. 3. The "E"-shaped core 3*a*, creating a yoke of three poles, is shown in cross-sectional representation. The fact that this "E"-shaped core 3*a* is substantially thin in the direction orthogonally into the paper for the cross-section shown in FIG. 3 will be further shown in FIG. 5. The "E"-shaped core 3*a* has a single coil 4 wrapped around the center pole. The armature 2 is striding across all three poles. The armature is retained at a pivot point upon the outer edge of "E"-shaped core 3*a* by O-ring 5, which is positioned so that no moment of force is provided by such O-ring to the striding of such armature 2. Such striding, induced by electromagnetic force generated in core 3*a* due to the passage of electricity through field coil 4, causes depression of printing needle 1 within the guides 9 to print a dot upon workpiece paper (not shown). Upon cessation of the application of magnetic force to armature 2, it, and printing needle 1, are enabled to return to the neutral, non-printing, position by forces exerted by spring 7. The relationship of all parts is maintained by retaining housing 6.

Figure 3A:
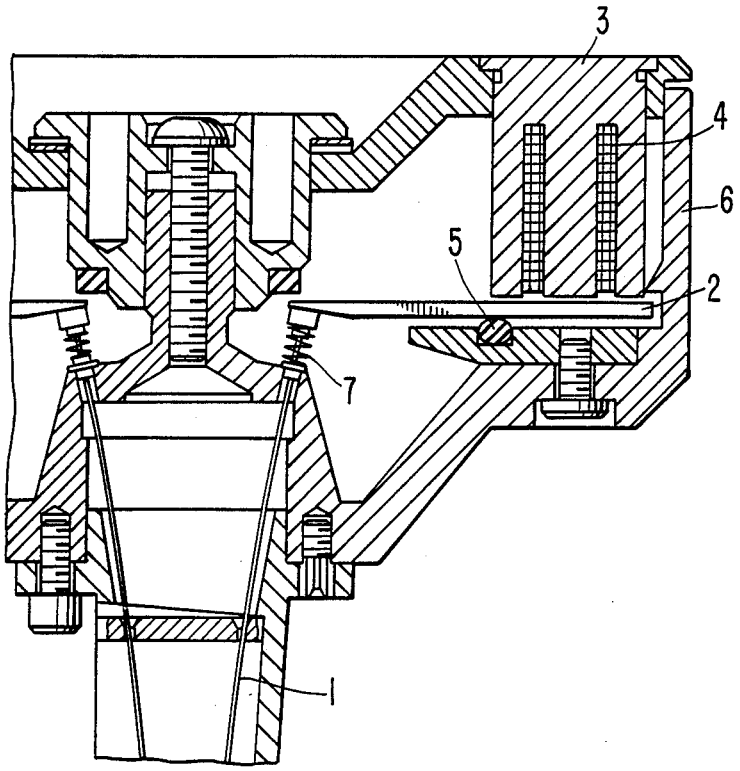

The three pole magnetic actuators of the present invention could be constructed as shown in FIG. 3*a*, similarly as is shown in FIG. 1*b* for the prior art two pole magnetic actuator, so that the armature is pivoted about the inner edge of the "E"-shaped core 3*a*. In such a case the O-ring 5 is positioned as an inner edge pivot as shown in FIG. 3*a*, and thus still adds no moment of force to the striding of the armature.

Figure 4:
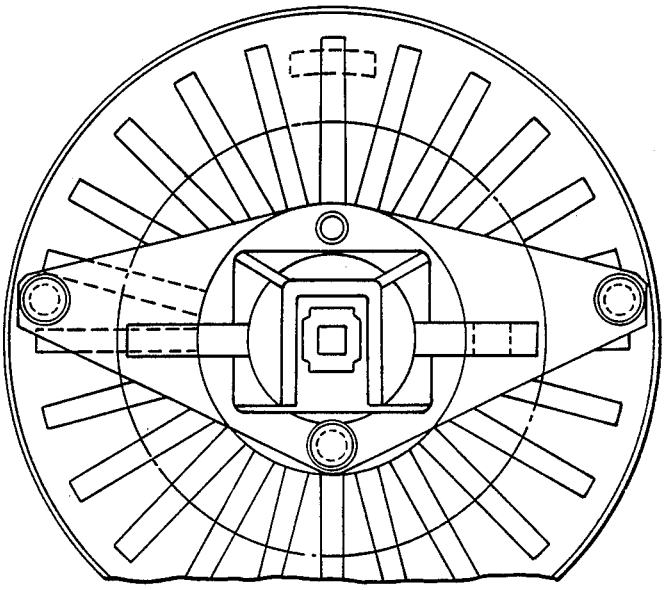
FIG. 4 shows an end view of a series of the magnetic actuators of the present invention arranged in a radial, or circular, array to collectively form a mosaic printhead.

The relationship of twenty-four (24) actuators constructed in accordance with the principles of the present invention aligned in a radial, or circular, array to form a wire matrix printhead for dot matrix printing is shown in FIG. 4. The manner by which the wires actuated by each of such magnetic actuators do converge in a center area so as to form a matrix of dot by which workpiece paper maybe printed is shown in the center area of FIG. 4.

Figure 5A:
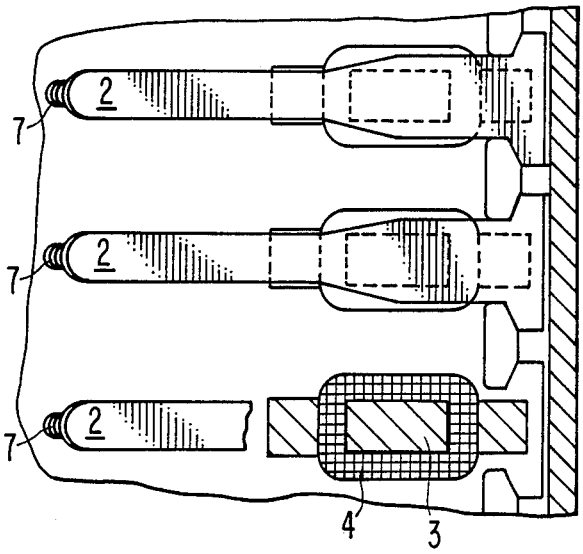
FIGS. 5 and 5*a* show a cross-sectional view, or orthogonal view of FIG. 3, of the "E"-shaped core of the prsent invention, and the proximate relationship of such cores within magnetic actuators which are radially, or circularly, arrayed within a mosaic printhead.
Figure 5:
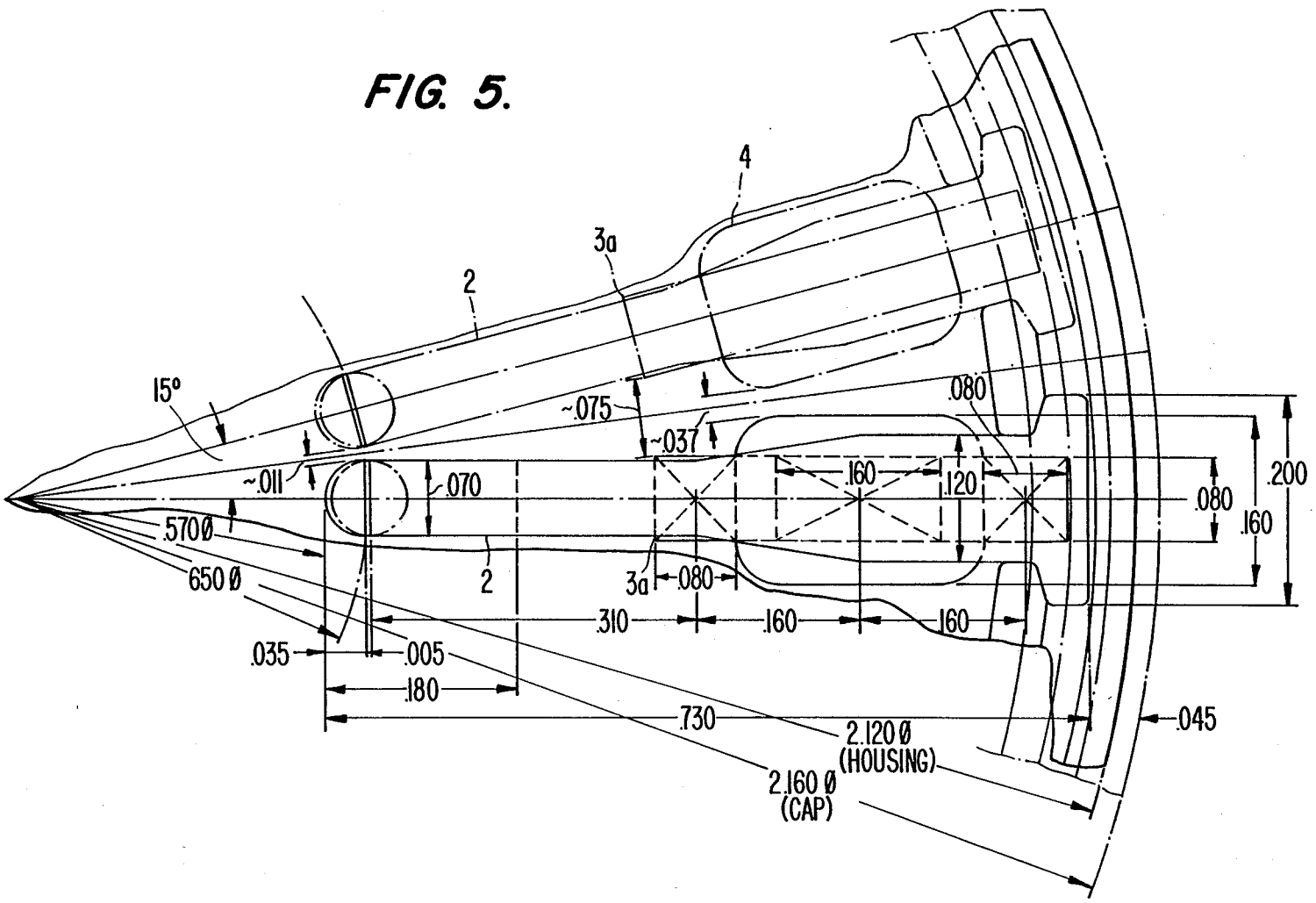

An expanded view in the same plane which was shown in FIG. 4, which plane is orthogonal to the plane of the cross-sectional view shown in FIG. 3, is shown in FIG. 5. The substantial limiting factor in the close radial packing of the magnetic actuators consisting of three-pole yoke 3*a*, field coil 4, and armature 2, is the thickness in the circumferential direction of the three-pole yoke 3*a* and of the field coil 4 which must wrap the center pole of such yoke 3*a*. It is illustrated for the "E"-shaped core, or three-pole yoke, 3*a* of the present invention that such is of substantially greater dimension in the radial direction than the thickness dimension of such "E"-shaped core, or three-pole yoke, in the circumferential direction. This is the meaning that the core should be "substantially thin" in the direction of the thickness of the "E", which direction is that direction circumferentially along the array of magnetic actuators. If the magnetic actuator of the present invention is arranged in a linear array as shown in FIG. 5*a* to form a linear printhead bank, then the thickness of the "E" is still along the direction of the (linear) array, and is "substantially thin" in that direction.

It may be further noted in FIG. 5 that when the "E"-shaped core is wrapped around the center pole with coil 4, then it still retains a net greater dimension in the radial direction than is presented by the combined thickness of such core 3*a* wrapped by coil 4. The typical radial dimension of the printhead formed of three-pole magnetic actuators, each of which subtends 15° allowing of 24 such to be disposed in an entire 360° circumference, is less than 6 centimeters.

Figure 6A:
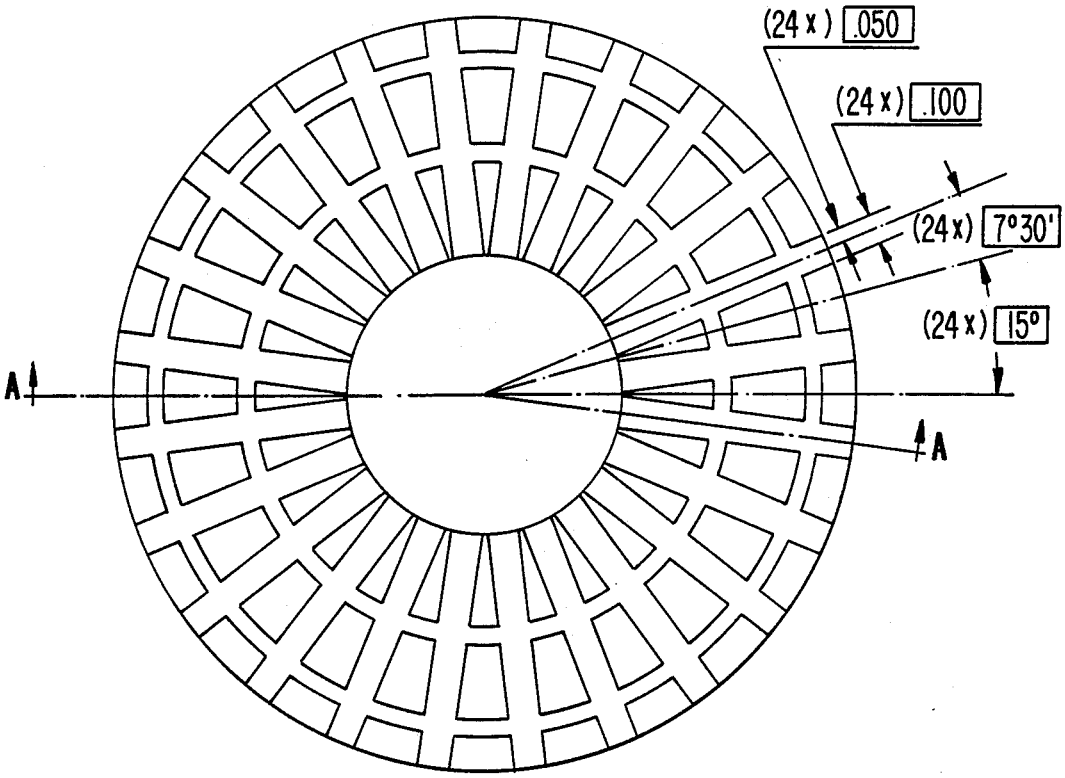
FIG. 6, consisting of FIG. 6*a* and FIG. 6*b*, show cross-sectional views of the "E"-shaped cores of plural magnetic actuators of the present invention when such, being arranged in a radial or circular array, share a common yoke.
Figure 6B:
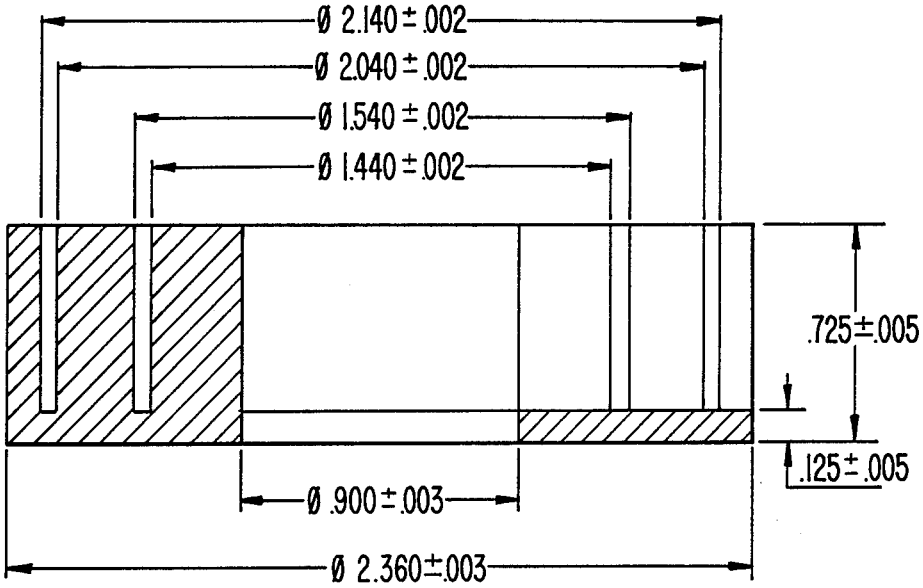

As a variant of the implementation of the present invention, the "E"-shaped core (shown in FIGS. 3–5) of the present invention may be constructed of magnetic materials laminated along the thickness of the "E", or of solid magnetic material. Further, in order to reduce costs a commonly fabricated yoke may be employed for all magnetic actuators in the same printhead. This common yoke may be laminated, may be sintered, or may be made by the casting of magnetic materials. An illustration of the structure wherein the "E"-shaped yoke of the arrayed magnetic actuators are structurally common is shown in FIG. 6. The common structure has twenty-four magnetic actuators in a circular array and is made from 3% silicon iron.

In consideration of the proceeding teaching, the present invention should be understood to be a magnetic actuator of improved, three-pole design. Further, an armature striding over all three magnetic poles of such three-pole magnetic actuator may be positionally maintained by an O-ring which creates no moment of force to the striding of such armature, whether such should be pivoted upon the inner, or upon the outer, pole of such three-pole magnetic actuator. Further, the "E"-shaped core of such magnetic actuator may be of laminated, or may be of solid, magnetic material and may further be constructed with the "E"-shaped core of a number of magnetic actuators arranged in a linear, or in a circular, array to be physically and magnetically common.

What is claimed is:

1. In a printhead having a series of magnetic actuators arranged in a circular array, an individual magnetic actuator comprising:

a three-pole magnetic actuator having a single coil wound around a center magnetic pole, an "E"-shaped core having a length oriented to extend radially in the circular array and defining the three magnetic poles along that length, said three magnetic poles each having a rectangular cross section, and said "E"-shaped core being substantially thin in the circumferential direction of said circular array of magnetic actuators compared to the length of the core such that said core has a substantially greater dimension in the radial direction of the circular array than in the circumferential direction thereof for enabling twenty-four such individual magnetic actuators to be disposed in a circular array having a diameter of less than 6 centimeters and an armature striding over all three magnetic poles.

2. The improved individual magnetic actuator of claim 1 further comprising:

O-ring means for defining the location of the pivot point of said armature striding over all three poles of said "E"-shaped core and for creating no moment of force to said striding of said armature.

3. The improved individual magnetic actuator of claim 2 wherein said O-ring means further comprises:

O-ring means for defining said location of said pivot point of said armature to be at its pole which is outermost relative to said circular array.

4. The improved individual magnetic actuator of claim 2 wherein said O-ring means further comprises:

O-ring means for defining said location of said pivot point of said armature to be at its pole which is innermost relative to said circular array.

5. The improved individual magnetic actuator of claim 1 wherein said "E"-shaped core further comprises:

an "E"-shaped core of magnetic material laminated along said thickness of the "E".

6. The improved individual magnetic actuator of claim 1 wherein said "E"-shaped core further comprises:

an "E"-shaped core of solid magnetic material.

7. The improved individual magnetic actuator of claim 1 wherein said "E"-shaped core further comprises:

an "E"-shaped core structurally common in at least one pole with like poles of other ones of said series of magnetic actuators arranged in a circular array.

8. The actuator of claim 1 wherein said "E"-shaped core has at least one pole held structurally in common with like poles of all other "E"-shaped cores of said series of magnetic actuators arranged in the circular array.

9. A three-pole magnetic actuator comprising:

an "E"-shaped core having a length defining three magnetic poles aligned along the length of the core, each of said poles having a rectangular cross section, and said core being substantially thin in thickness compared to the length of the core, the thickness being that direction perpendicular to an imaginary line in the plane of and connecting the three poles, such that twenty-four such magnetic actuators may be disposed in a circular array having a diameter of less than 6 centimeters.

10. In magnetic actuator for use in a wire matrix printhead in which force is applied to each wire by a pivotally mounted magnetically actuated armature driven by said actuator, the improvement wherein:

said actuator has an E-shaped core having a generally rectangular cross-section and forming a 3-pole yoke, said printhead armature extending along the open ends of all three poles of the E-shaped core, the poles being aligned along the length of the core and each pole having a rectangular cross section, the thickness of the core compared to the length of the core being sufficiently small in the direction perpendicular to an imaginary line in the plane of and connecting the poles such that twenty-four such magnetic actuators may be disposed in a circular array having a diameter of less than 6 centimeters and a single core wound around only the center leg of said E-shaped core, so that when single coil is energized, dual flux paths are produced extending from said center leg respectively to each of the outer legs of said E-shaped core, both flux paths encompassing said armature to significantly increase the magentic flux to which said armature is exposed as compared with a U-shaped actuator core.

* * * * *